US009428915B2

(12) United States Patent
Nark

(10) Patent No.: US 9,428,915 B2
(45) Date of Patent: Aug. 30, 2016

(54) HEATED ROOF DRAINAGE RACEWAY WITH SELF ADJUSTING HEATING CABLE CAVITY

(71) Applicant: Malcolm Brent Nark, Aspen, CO (US)

(72) Inventor: Malcolm Brent Nark, Aspen, CO (US)

( * ) Notice: Subject to any disclaimer, the term of this patent is extended or adjusted under 35 U.S.C. 154(b) by 248 days.

(21) Appl. No.: 14/145,637

(22) Filed: Dec. 31, 2013

(65) Prior Publication Data

US 2015/0184394 A1 Jul. 2, 2015

(51) Int. Cl.

| | |
|---|---|
| ***E04D 13/04*** | (2006.01) |
| ***E04D 13/076*** | (2006.01) |
| ***E04D 13/10*** | (2006.01) |
| ***H05B 3/30*** | (2006.01) |
| ***H05B 3/56*** | (2006.01) |
| *H05B 3/26* | (2006.01) |

(52) U.S. Cl.

CPC ..... *E04D 13/103* (2013.01); *H05B 3/56* (2013.01); *E04D 13/0762* (2013.01); *E04D 13/10* (2013.01); *E04D 2013/0418* (2013.01); *H05B 3/26* (2013.01); *H05B 2203/014* (2013.01); *H05B 2203/02* (2013.01); *H05B 2214/02* (2013.01)

(58) Field of Classification Search

None

See application file for complete search history.

(56) References Cited

U.S. PATENT DOCUMENTS

| | | | | |
|---|---|---|---|---|
| 2,699,484 | A | 1/1955 | Michaels | |
| 3,074,676 | A | 1/1963 | Watson | |
| 3,207,211 | A | 9/1965 | Winterfeldt | |
| 3,521,029 | A | 7/1970 | Toyooka et al. | |
| 3,691,343 | A * | 9/1972 | Norman | E04D 13/103 219/213 |
| 3,725,638 | A * | 4/1973 | Solin | E04D 13/103 219/213 |
| 4,189,881 | A | 2/1980 | Hawley | |
| 4,401,880 | A * | 8/1983 | Eizenhoefer | E04D 13/103 219/213 |
| 4,848,051 | A | 7/1989 | Weisner et al. | |
| 5,391,858 | A * | 2/1995 | Tourangeau | E04D 13/0762 219/213 |
| 5,496,005 | A | 3/1996 | Dieringer | |
| 5,829,206 | A | 11/1998 | Bachman | |
| 5,836,344 | A | 11/1998 | Hovi, Sr. | |
| 6,225,600 | B1 | 5/2001 | Burris | |
| 6,499,259 | B1 | 12/2002 | Hockman | |
| 6,668,491 | B1 | 12/2003 | Bonerb | |
| 6,700,098 | B1 * | 3/2004 | Wyatt | E04D 13/0762 219/213 |
| 6,759,630 | B1 | 7/2004 | Tenute | |
| 6,852,951 | B2 | 2/2005 | Heise | |
| 7,071,446 | B1 | 7/2006 | Bench | |
| 7,104,012 | B1 | 9/2006 | Bayram | |
| 7,104,013 | B1 | 9/2006 | Gates et al. | |
| 7,287,354 | B2 | 10/2007 | Rivers et al. | |

(Continued)

OTHER PUBLICATIONS

Heat-line Freeze Protection Systems, Edge-Cutter(R) Roof De-icing System, Product Brochure, 2006, 4 pages.

(Continued)

*Primary Examiner* — Joseph M Pelham

(57) ABSTRACT

If roof top snow melt water is allowed to refreeze on the colder areas of the roof, an ice dam can be formed. A heated drainage path ensures this water is drained away from the structure's foundation. The various sheet metal raceway products disclosed contain spring-like folded members to securely press against the self-regulating heating cable, thereby maximizing the thermal conduction between the heating cable and the sheet metal raceways. The spring-like members of the raceways ensure a tight thermal contact to heating cables of different thicknesses. The spring-like members compensate for metal fatigue to provide a longer useful life of the installed system. The system also allows easy end of life replacement of the heating cable.

18 Claims, 11 Drawing Sheets

(56) References Cited

U.S. PATENT DOCUMENTS 7,448,167 B2 11/2008 Bachman
7,681,363 B2 3/2010 Banister
8,191,319 B2 * 6/2012 Nark ..... E04D 13/103 52/11
8,205,397 B2 * 6/2012 Nark ..... E04D 13/103 52/58
8,440,940 B2 * 5/2013 Backe ..... E04D 13/103 219/213
8,490,336 B2 * 7/2013 Nark ..... H05B 3/06 219/213
8,607,509 B2 * 12/2013 Gurr ..... E04D 13/103 52/173.3
8,782,960 B2 * 7/2014 Nark ..... G06Q 10/00 219/213
8,946,601 B2 * 2/2015 Casey ..... H05B 3/06 219/213
9,045,907 B2 * 6/2015 Clark ..... E04D 13/103
9,095,007 B2 * 7/2015 McGillycuddy ..... E04D 13/103
9,121,179 B2 * 9/2015 Bublitz ..... E04D 13/0762
2001/0025839 A1 10/2001 Jones
2004/0140002 A1 7/2004 Brown et al.
2005/0139585 A1 6/2005 Knappmiller
2005/0193637 A1 * 9/2005 Petroff ..... E04D 13/103 52/11
2006/0037252 A1 2/2006 Gosse et al.
2006/0096968 A1 5/2006 Livermore
2006/0196124 A1 9/2006 Bachman
2006/0213129 A1 9/2006 Bachman
2006/0277831 A1 12/2006 Bachman
2006/0288652 A1 * 12/2006 Gurr ..... E04D 13/103 52/198
2008/0196352 A1 8/2008 Grove
2008/0302928 A1 12/2008 Haddock
2010/0024324 A1 * 2/2010 Meinzer ..... E04D 13/103 52/173.1
2011/0042366 A1 * 2/2011 Martin ..... E04D 13/0445 219/213
2011/0047892 A1 * 3/2011 Nark ..... E04D 13/103 52/95
2011/0047927 A1 * 3/2011 Nark ..... E04D 13/103 52/741.1
2011/0047930 A1 * 3/2011 Nark ..... H05B 3/06 52/745.19
2011/0049118 A1 * 3/2011 Nark ..... E04D 13/103 219/213
2011/0089154 A1 * 4/2011 Aussi ..... E04D 13/064 219/213
2011/0209434 A1 * 9/2011 Nark ..... H05B 3/06 52/745.21
2011/0232210 A1 * 9/2011 Backe ..... E04D 13/103 52/173.3
2012/0067868 A1 * 3/2012 Casey ..... H05B 3/565 219/546
2012/0091116 A1 * 4/2012 Casey ..... H05B 3/06 219/213
2012/0132759 A1 * 5/2012 Sager ..... E04D 13/0762 248/49
2012/0168419 A1 * 7/2012 Bublitz ..... E04D 13/103 219/213
2013/0319990 A1 * 12/2013 Casey ..... E04D 13/103 219/213
2014/0097178 A1 * 4/2014 Whitcraft ..... H05B 3/34 219/528
2014/0299593 A1 * 10/2014 Casey ..... H05B 3/565 219/476
2014/0326837 A1 * 11/2014 Rumsey ..... F16L 3/06 248/65
2015/0114947 A1 * 4/2015 Casey ..... H05B 3/06 219/213

OTHER PUBLICATIONS

Raychem Corporation, IceStop GMK-RC Roof Clip and GM-RAKE Hanger Braket, product brochure, Mar. 1999, 4 pages.
Raychem Corporation, IceStop product information sheet, Oct. 1984, 1 page.
Chromalox.RTM Edge-Cutter.RTM. Roof De-Icing System product brochure, 2 pages, published on or before Aug. 24, 2008.
Victorian Metal Shingle, Snow Belt System, 3 pages, offered for sale on or before Aug. 24, 2008.
EN-RaychemIceStopRoofGutterDeIcing-IM-H58067 Mar. 2013 p. 37 J-hook heated panel http://pentairthermal.com/Images/EN-RaychemIceStopRoofGutterDeIcing-IM-H58067_tcm432-26320.pdf.

* cited by examiner

FIG. 4
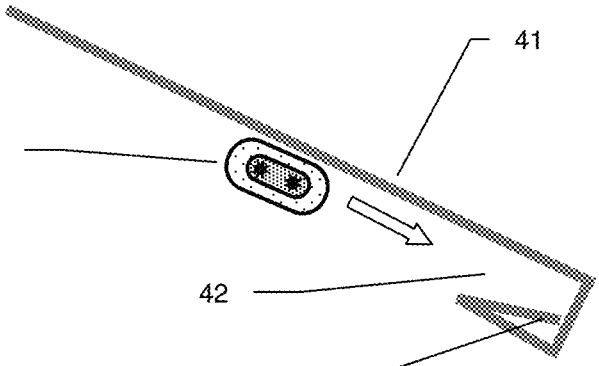
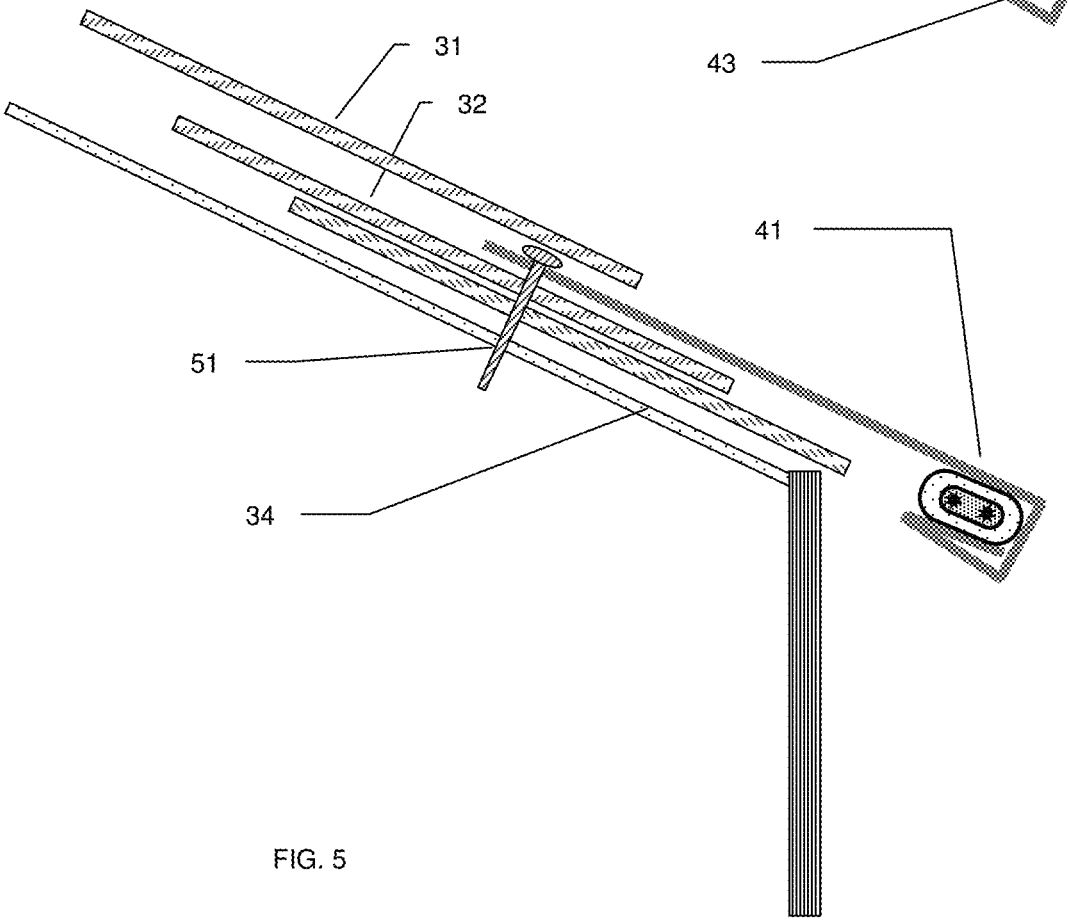
FIG. 5

HEATED ROOF DRAINAGE RACEWAY WITH SELF ADJUSTING HEATING CABLE CAVITY

BACKGROUND OF THE INVENTION

In high snow load regions, roof top snow can melt into water due to escaping heat from the structure's interior or thermal radiation from the sun. When this water drains to the colder overhang or other colder roof surfaces the water can refreeze creating an ice dam. Ice dams can also form in the valley between adjoining roof surfaces or next to roof protrusions such as chimneys, dormers or second story structures. A continuously heated drain path, including heated gutters and down spouts, ensure the water is drained away from the structure's foundation.

These ice dams can prevent additional snow melt water drainage and standing water is formed above the ice dam. Most slanted roofs are designed to shed moving water like an umbrella, not to hold standing water like a swimming pool. This standing water can penetrate a standard roof and enter the structure causing interior damage, mold, mildew and electrical issues. If this water is allowed to re-freeze, the change-of-state expansion can cause major structural damage.

To provide a heated drain path though the ice dam, the state of the art for professional installations utilizes self-regulating electrical heating cable that increases the heat output per foot when the cable is in direct contact with ice and snow. When the drainage path around the cable is established, the air pocket acts like a storm window and greatly reduces the thermal conduction between the heating cable and the ice and snow. As the electrically semi-conductive cable core heats up, the electrical resistance between the electrical bus wires increases and the electrical wattage used per foot decreases. A typical self-regulating ice and snow melt cable can create a load of 24 watts per foot in ice and snow at −10° F. but drops to about 6 watts per foot in ambient air at 32° F. So the air pocket around the cable becomes an important variable in the system and product design.

Increasing the size of the melt path has been the goal of the industry for many years. A single run of cable provides about a two inch wide drain path. A zig-zag placement of the cable provides a wider coverage area but ice can form between the zig and the zag and the additional cable length adds cost and requires more electrical power.

Embedding the cable in a fixed width cavity inside a thermally conductive metal panel system works quite well to increase the size of the melt path, which is the goal. Some heavy weight extruded panels are offered that have a high fixed thermal mass, ensuring maximum heat sinking and electrical power usage from the self-regulating heating cable. However, over time the thermal expansion and contraction of the cavity size of any current panel design reduces the contact area between the cable and the metal. A very small thermal air gap can reduce the self-regulating cable's heat output and the temperature of the metal panel dramatically.

BRIEF SUMMARY OF THE INVENTION

Maintaining a long term, thermally conductive contact between the self-regulating heating cable and the snow melt metal panel or metal surface is the main focus of this disclosure. System cost and energy efficiency are also important. This invention uses low cost sheet metal panels with spring loaded members in the cable cavity that ensures firm, long term contact with the heating cable. To address energy efficiency, the variable thermal mass of light weight sheet metal becomes a factor. The light weight sheet metal panel system only uses large amounts of electrical power when loaded down with snow and ice which increases the thermal mass of the panel. When the snow and ice have drained away, the variable mass of the cleared panel decreases dramatically and the self-regulating cable current consumption goes down, saving energy.

BRIEF DESCRIPTION OF THE SEVERAL VIEWS OF THE DRAWINGS

FIG. 4 shows a one piece panel system with a multi-segment cavity to retain the heating cable. This one piece panel is an alternative to the two piece panel shown in FIG. 3.

FIG. 5 shows the mounting of the one piece panel on a shingled roof using a self-drilling construction screw.

DETAILED DESCRIPTION OF THE INVENTION

Figure 1:
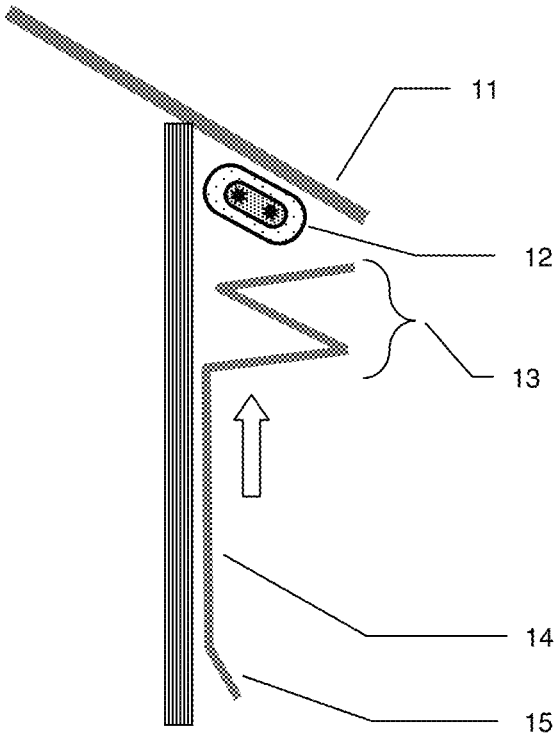
FIG. 1 shows an exploded view of a three element, multi-segment or bellows type of heating cable retention system that firmly presses the cable against the bottom of a metal drip edge usually found on raised seam metal roofs.

In high snow load regions, snow melt water tends to refreeze on the colder lower areas of the roof. Higher on the roof the snow is exposed to the heat escaping from inside the structure. Top floor ceiling penetrations for overhead lights and ventilation duct work can create massive heat loss from inside the structure to the attic space which then heats the bottom side of the roof deck which can melt the snow on the top of the roof deck. Solar heating of the snow on the upper part of the roof also contributes to snow melt water in areas not shaded by trees. This snow melt water usually stays under the snow, much like the effect seen in a glass of ice water—the solid snow and ice float on top of a layer of water. This water then drains down the roof, under the snow and ice, and tends to re-freeze on the colder roof surface over the unheated roof overhang. This can lead to large ice formations at the roof drip edge which can fall to the ground causing damage to property and injury to people.

Colder roof surfaces can also be found where snow depth increases, for example in the valley between adjoining roof surfaces or behind roof protrusions like chimneys or second stories. The lower roof surfaces are sometimes shielded from solar heating due to the angle of the sun in winter or by trees planted too close to the structure. When this moving water is exposed to the colder roof surfaces it will sometimes refreeze creating what is called an ice dam. This sold ice formation builds in size and height and prevents continued drainage of the snow melt water coming down the roof. The standing water increases in depth and can leak back under the shingles or other roofing material into the interior of the structure. Normal roofs are designed to shed moving water like an umbrella, not to hold standing water like a swimming pool.

When this standing water leaks into the structure, it can cause mold, mildew and damage to electrical systems. It can leak through the ceiling and destroy furniture, carpet and other household goods. Often times this water re-freezes and the change-of-state expansion has the power to separate structural members that are nailed together or to destroy the glue or sealing bond between surfaces. If the water is permitted to collect around the structure's foundation and refreeze, the concrete foundation can crack and leak water into the basement. This structural damage may not be recognized for a period of time. The first priority under these conditions is to provide a continuously heated drain path for the snow melt water to drain off the roof, into a heated gutter and downspout and away from the structure's foundation.

Contrary to common belief, best practice is to provide a heated drain path for the snow melt water rather that to use the extra electrical energy required, due to the latent heat of fusion (hidden heat required for change of state from solid to liquid) to melt ice once it is formed. This suggests that a system using self-regulating heating cable powered 24 hours a day is more energy efficient than using a timer to turn off the system a night which allows the snow melt water to refreeze only to use additional electrical energy to melt the ice the next day so it can drain from the roof structure.

Over the years, many systems have been developed to deal with these drainage issues. The miner's shacks of the 1800's had metal slip sheets or snow slides placed at the roof edge, around the perimeter of the building. When these metal panels were heated by the sun and the up-roof snow melt drainage water, the snow and ice would lose adhesion and slide to the ground. Electrical constant-current heating cables were introduced in the mid 1900's and are still used today to provide a heated melt path for snow melt water.

Self-regulating heating cables were introduced in the late 1900's that had a semi-conductive carbon infused plastic core between two electrical buss wires that would lower the electrical resistance between the buss wires as the core became colder, and increase resistance between the buss wires as the core warmed up. This was a major energy saving improvement. The cable would use more electrical energy per foot the colder the core became. As the core warmed up, the electrical resistance between the buss wires would increase and the electrical energy used per foot would decrease.

These self-regulating heating cables would be placed on the roof surface and in the gutters and downspouts to create a heated drainage paths for the snow melt water until it was safely drained away from the structure's foundation.

Combining self-regulating heating cable with the slip sheets of the 1800's was the next step in the evolution. Some slip sheets were made from heavy extruded aluminum to present a high thermal mass heat sink to the self-regulating heating cable. Later, lower cost sheet metal slip sheets combined with self-regulating heating cable were introduced.

But both types of slip sheets had the same type of fixed size cavity for the self-regulating heating cable. A tight contact between the heating cable and the metal panel is very important for thermal conductivity. Any air space acts like thermal insulator, similar to a storm window. With this partial thermal insulation, the self-regulating heating cable core warms up prematurely and produces less heat output.

The heavy metal extrusion panel had a fixed size cavity that did not offer a tight flexible contact to the heating cable and a sheet metal cover that sometimes made cable replacement difficult. Over time, the thermal expansion and contraction of the sheet metal panel systems would cause metal fatigue and the cavity size would increase. Sometimes the heating cable would fall out of the cavity. In both cases, thermal conduction between the metal panel and the heating cable would degrade, the cable core would warm up and the heat output of the cable would decrease.

The inventions disclosed herein are an improvement to the previous designs by offering a multi-segment spring loaded or bellows type of metal to cable thermal contact that is flexible and not subject to metal fatigue. The multiple-segments act like leaf springs along the length of the cable raceway. Ease of cable insertion, long term cable retention and high thermal conductivity combined with the low cost advantage of sheet metal is the next generation of this type of product disclosed in this invention.

Figure 2:
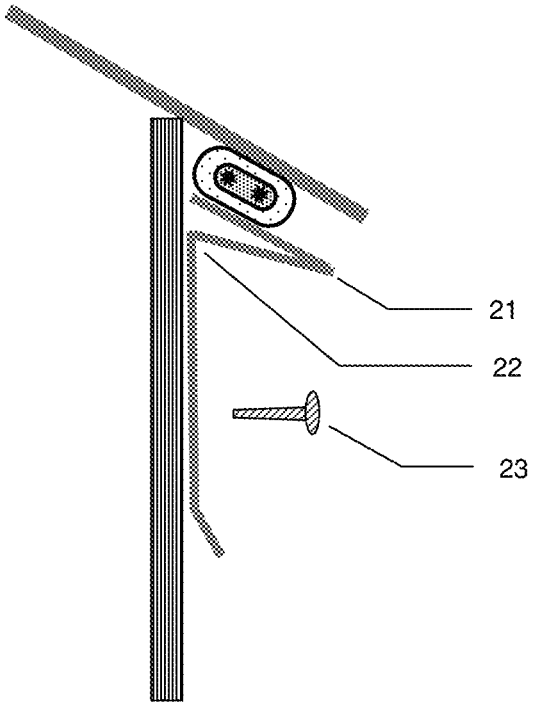
FIG. 2 shows the compressed view of a two element bellows system pressing the heating cable to the bottom of the metal drip edge and the mounting screw that is used to hold the retention strip in place.

FIG. 1 illustrates a three part multi-segment 13 spring loaded or bellows type of retention strip 14 used to retain a tight contact between the heating cable 12 and the bottom of a metal drip edge 11. The extra element added in the retention strip 13 in FIG. 1 is sometimes required to mate to a roof edge that is very wavy or exhibits "oil canning" in the parlance of the trade. The kick-out 15 prevents water wicking into the space behind the strip 14. FIG. 2 shows the installation of a two part element spring strip with the attachment screw 23. The metal bends 21 and 22 ensure tension on the elements that bow and act as leaf springs. A small amount of the cable is exposed to conform to some local interpretations of Article 426 of the National Electrical Code. These strips can be made of copper, steel or aluminum sheet metal by bending on a brake or using a roll forming machine.

Figure 3:
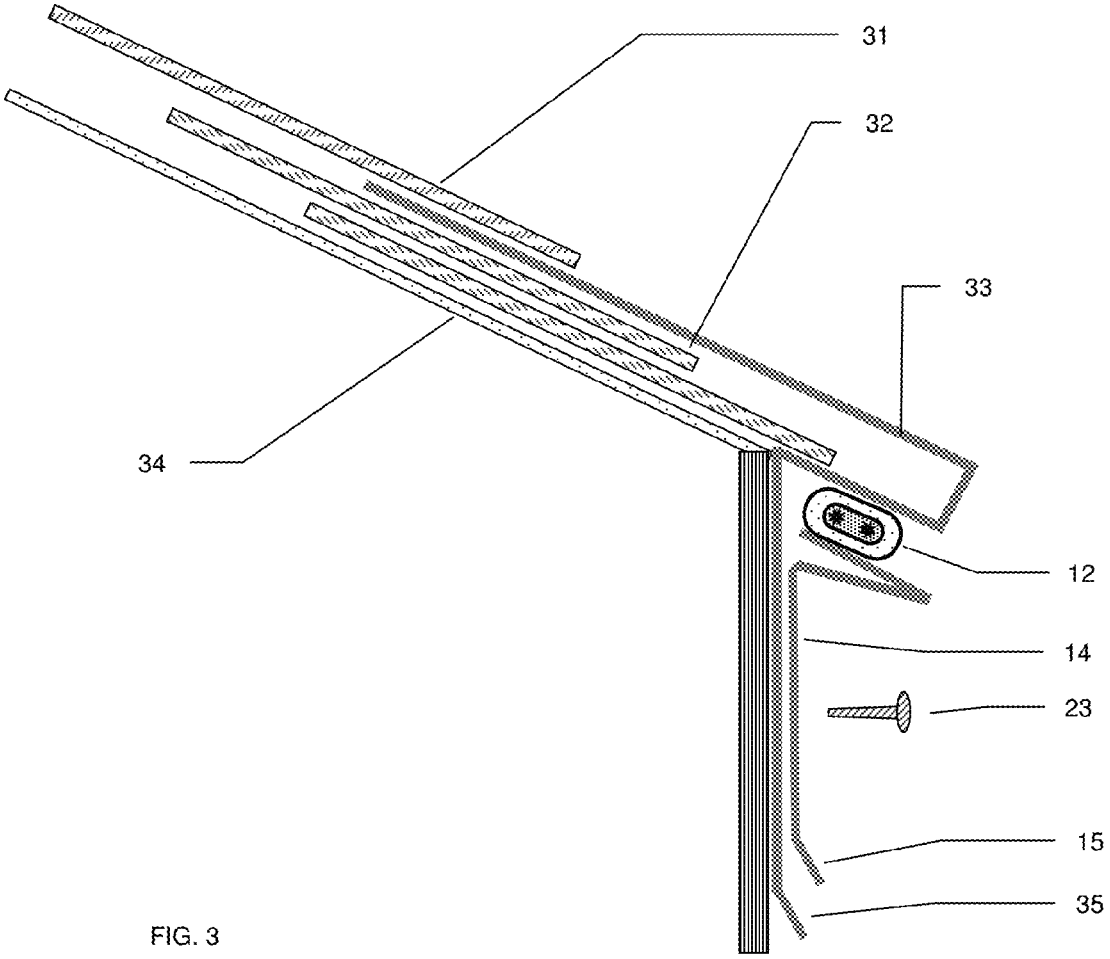
FIG. 3 shows a two part system that is required for roof edge heating for roofs with non-thermally conductive materials such as asphalt composite shingles. The top mounted metal slip sheet (or snow slide) is heated from the bottom by the heating cable which is held in place by the multi-segment retention system.

FIG. 3 shows the slip sheet 33 slid under the second or third shingle 31 but on top of the lower shingles 32 that is on top of the roof deck 34. This provides a heat conductive metal surface up the roof that is heated by the self-regulating heating cable 12. The multi-segment retention strip 14 is held in place by the retention screw(s) 23. Kick outs 35, 15 are provided for the slip sheet panel 33 and for the retention rail 14.

FIG. 4 shows a rear loaded multi-segment 43, spring loaded heating cable cavity 42 that holds the heating cable 12. As shown in FIG. 5, the panel 41 can be held in place with the attachment screw(s) 51 or glued in place at the screw location. For new construction the screw may be preferred. For retro-fit applications, glue eliminates having to bend the shingle up to insert the screw. This presents a clean look at the drip edge, but hides the cable which may be allowed depending on the local interpretation of Article 426. Removal and replacement of the cable requires lifting the panel. This type of one part product does not vary with roof pitch, unlike the two part configuration shown in FIG. 3. This allows for a standardized product that is appropriate for the inventoried retail sales channels.

Figure 6:
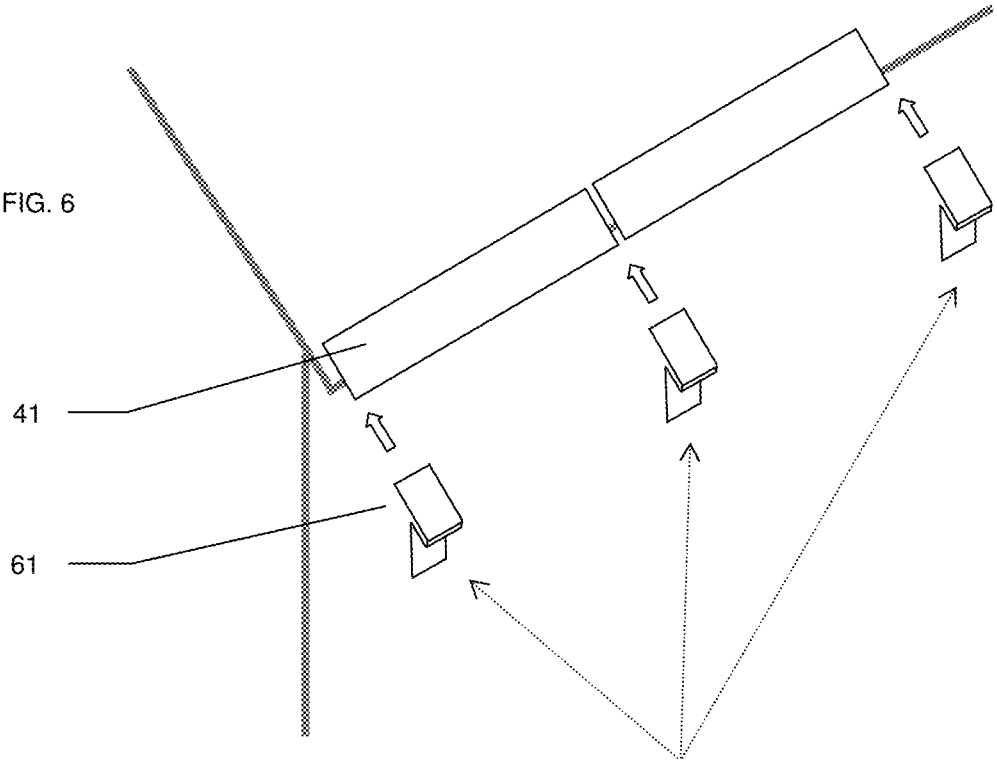
FIG. 6 shows the one piece panel layout on a typical shingled roof. Also shown are three transitional brackets.
Figure 7:
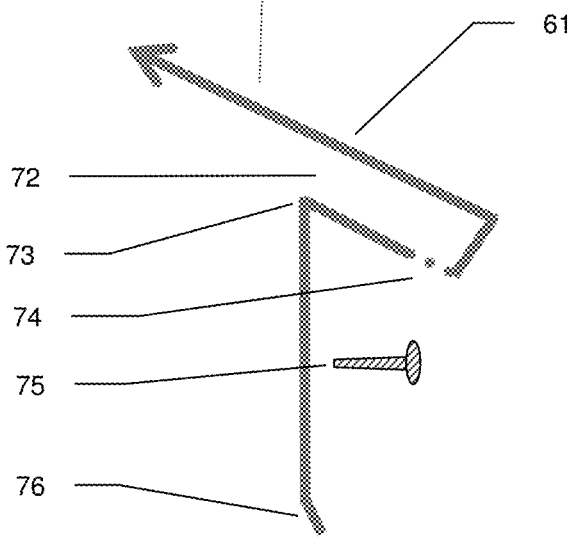
FIG. 7 shows a close up of the transition bracket that is used to retrain both ends of each panel. To avoid roof penetration with the roof top screw retention shown in FIG. 5, these transition brackets are attached to the structure with screws into the fascia that are protected by the roof edge overhang.

FIG. 6 shows the transition panels 61 which provide additional retention for the heated panels 41. FIG. 7 shows the cut-away view of the transition panel 61 with a water drainage hole 74. The larger cavity 72 transition panels 61 mount around the bottom edge of both ends of the heated panels 41 to hold them in place and is attached to the fascia with mounting screws 75. This type of retention holds the panels securely in place without the roof penetrating screw(s) 51 as shown in FIG. 5. The kick out 76 prevents water wicking behind the transition panel 61. The final bend 73 location is determined by the distance back to the front fascia and can be ordered to this dimension or the bend can be formed during installation.

Figure 8:
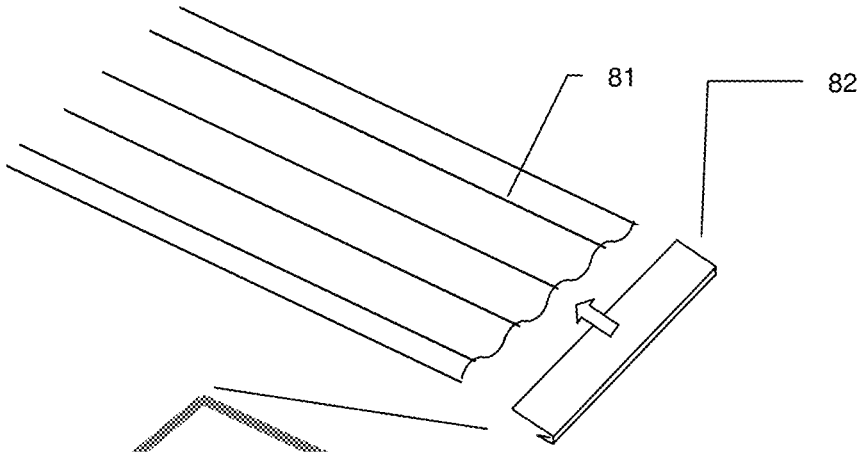
FIG. 8 shows a one piece heated panel placed under a corrugated, rib or raised seam metal roof to provide a heated roof drip edge.
Figure 9A:
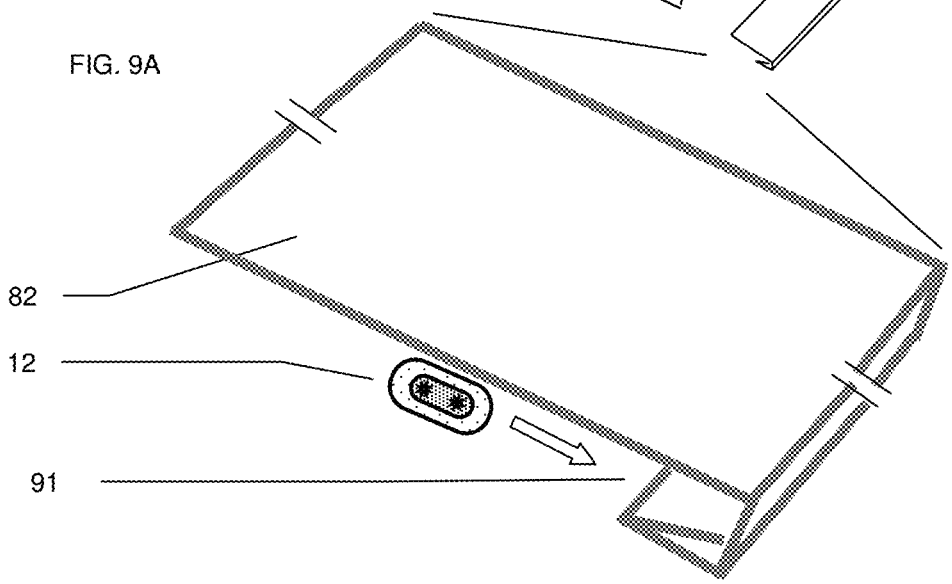
FIG. 9A shows a close-up of the one piece panel with the multi-segment cable retention cavity system for a corrugated or rib panel metal roof.
Figure 9B:
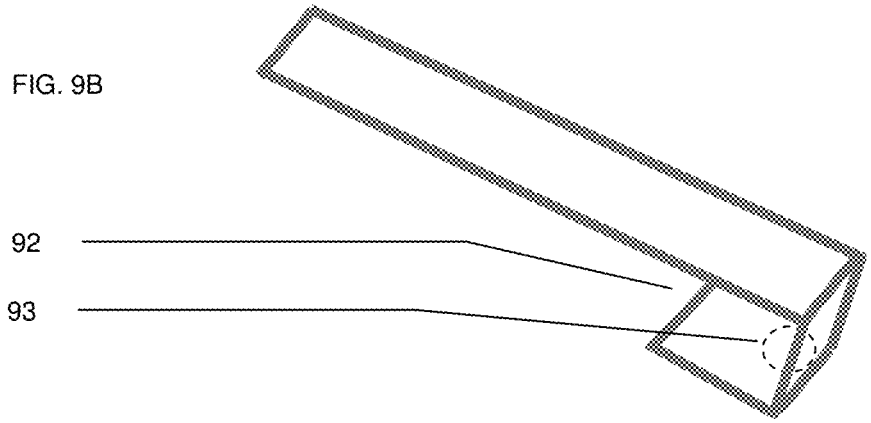
FIG. 9B shows a transition panel for the panels shown in FIG. 9A.

FIG. 8 shows a rear entry heating panel 82 with a multi-segment heating cable retention cavity that installs under a metal corrugated, rib or raised seam roof 81. A cable retention strip 14 as shown in FIG. 1 could be used, but the larger surface area between the cable and the panel and the bottom of the metal roof provides more thermal conductivity than having only the narrow cable in contact with only the bottom protrusion area of a wavy roof 81. It has been found that trying to bend the cable up and down into the cavities of the corrugations is very difficult. FIG. 9A shows the cross sectional close-up detail of the heating cable 12 as it enters the multi-segment heating cable retention cavity 91. FIG. 9B shows the narrow transition cover panel with the larger cavity 92 and drain hole 93 that slides over the gaps between the longer panels shown in FIG. 9A.

Figure 10:
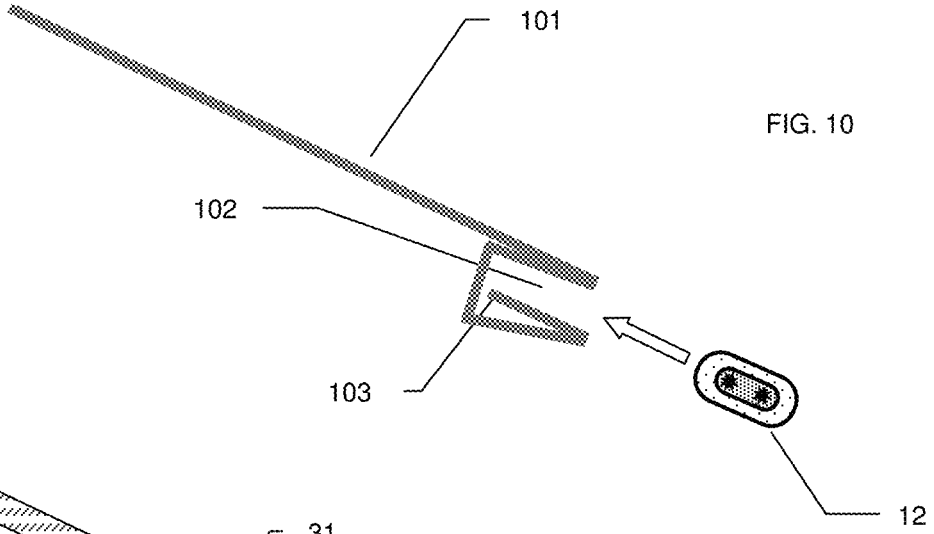
FIG. 10 shows a heating panel with a front loading multi-segment heating cable retention cavity. This is an alternative to the other panels that have a rear loading cavity.
Figure 11:
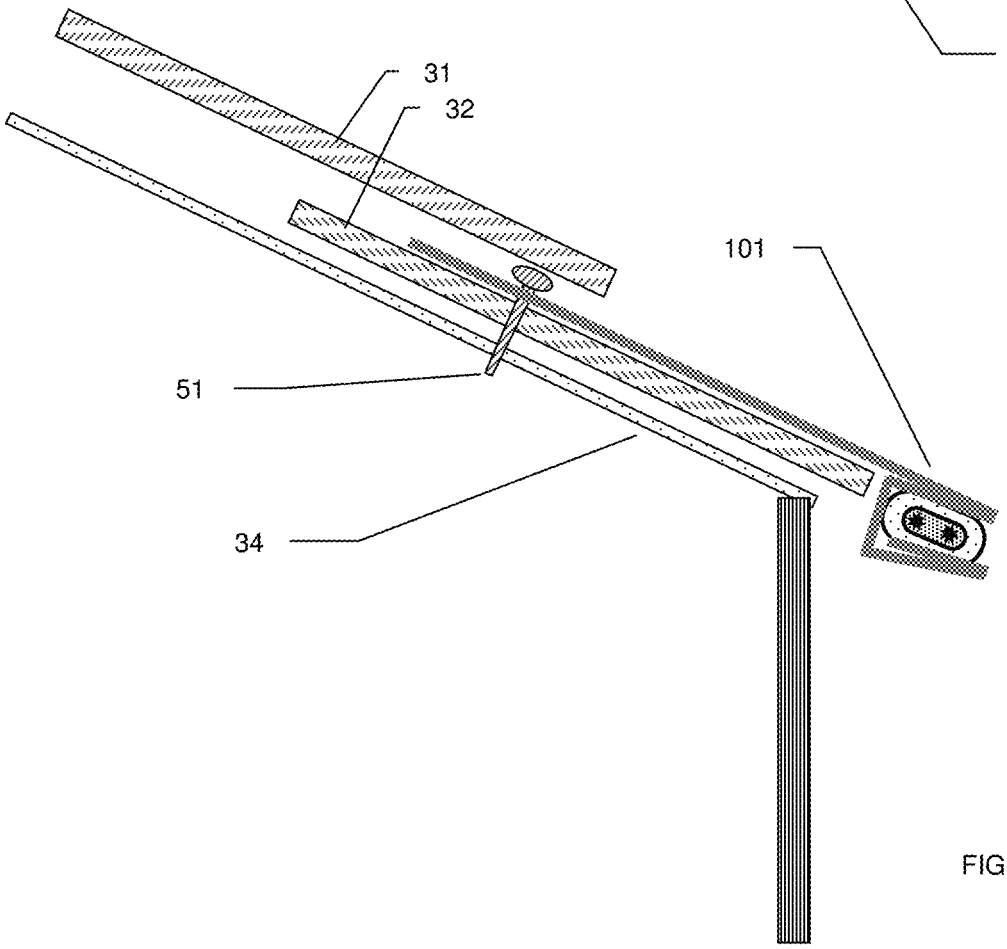
FIG. 11 shows the front loading design offers a shorter overhang from the roof edge and may provide for easier cable removal and replacement.

FIG. 10 shows a front entry panel 101 with a multi-segment 103 heating cable 12 retention cavity 102. FIG. 11 shows the installation of the panel 101 under the second shingle of a roof with very large or thick shingles 31, 32. For standard shingles the panel would cover the bottom two shingles as shown in FIG. 5. The retention screw(s) 51 mount the panel on top of the lower shingle 32 which is on top of the roof deck 34. Instead of the retention screw(s) 51, an appropriate adhesive may be used in retro-fit applications. Although more expensive to make because of the additional bend, this front entry product offers a shorter protrusion from the shingle edge which may be helpful in situations where the water drainage from the roof over the extended rear entry heated panel over-shoots the gutter. Cable replacement may be easier from the front and the partial cable exposure may be required by local inspection authorities. The same multi-segment heating cable cavity ensures a tight contact of the cable to the metal and long term retention not subject to metal fatigue issues.

Figure 12:
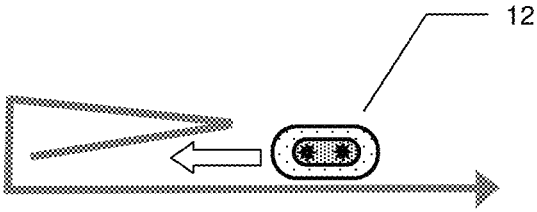
FIG. 12 shows a cross sectional view of a roof top heated utility panel with a multi-segment cable retention cavity.
Figure 13:
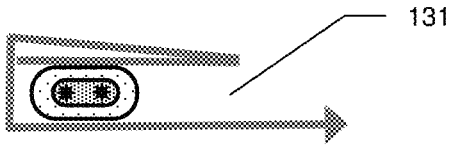
FIG. 13 shows the cross sectional view of the utility panel with the heating cable in place within a multi-segment cable retention cavity.
Figure 13A:
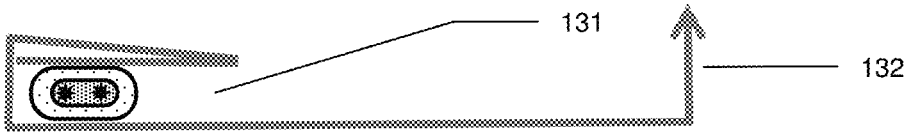
FIG. 13A shows an extended width panel with a vertical member (131).
Figure 14:
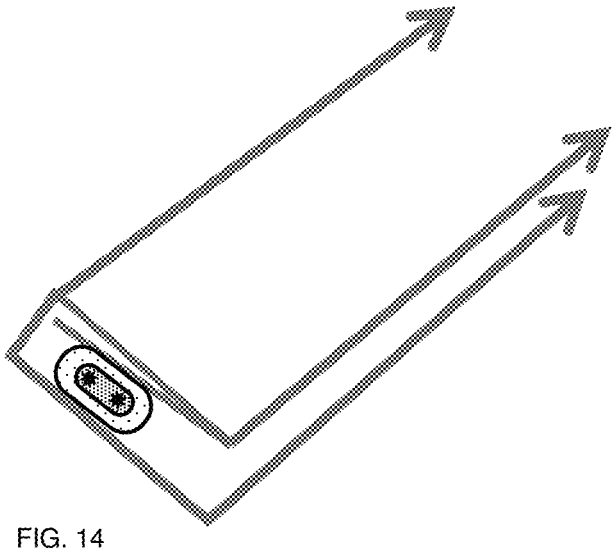
FIG. 14 shows the three dimensional view of the long utility panel with a multi-segment cable retention cavity. These panels can be placed around and above roof penetrations such as chimneys, dormers or second story structures to provide a heated drain path in areas subject to snow retention. They can also be placed in valleys where different roofs converge.

FIGS. 12 and 13 shows a utility panel with a multi-segment heating cable 12 retention cavity 131 that can be screwed or glued in place under or on top of shingles or other roofing materials in the roof valleys. FIG. 13A shows a vertical bend 132 that allows the heating cable raceway to be used as a flashing against a vertical surface such a dormer, second story or chimney. In all cases the multi-segment heating cable 12 retention cavity 131 provides long term retention of the heating cable 12 and maximum thermal heat transfer from the heating cable to the metal raceway. FIG. 14 shows the cross-sectional view of the panel that would typically be about five feet long.

Figure 15:
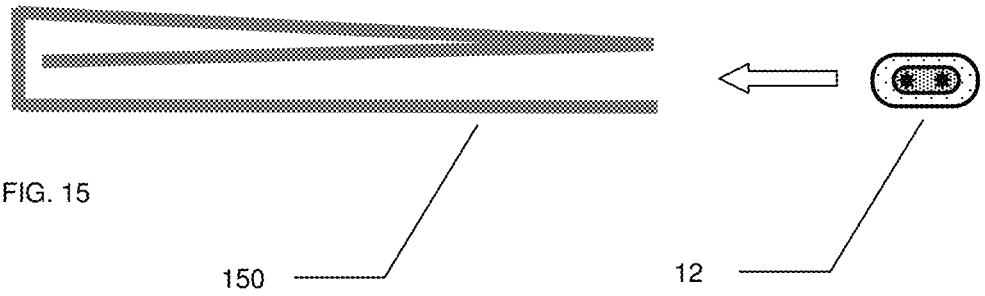
FIG. 15 shows a cross sectional view of a wider utility panel with a multi-segment cable retention cavity.
Figure 16:
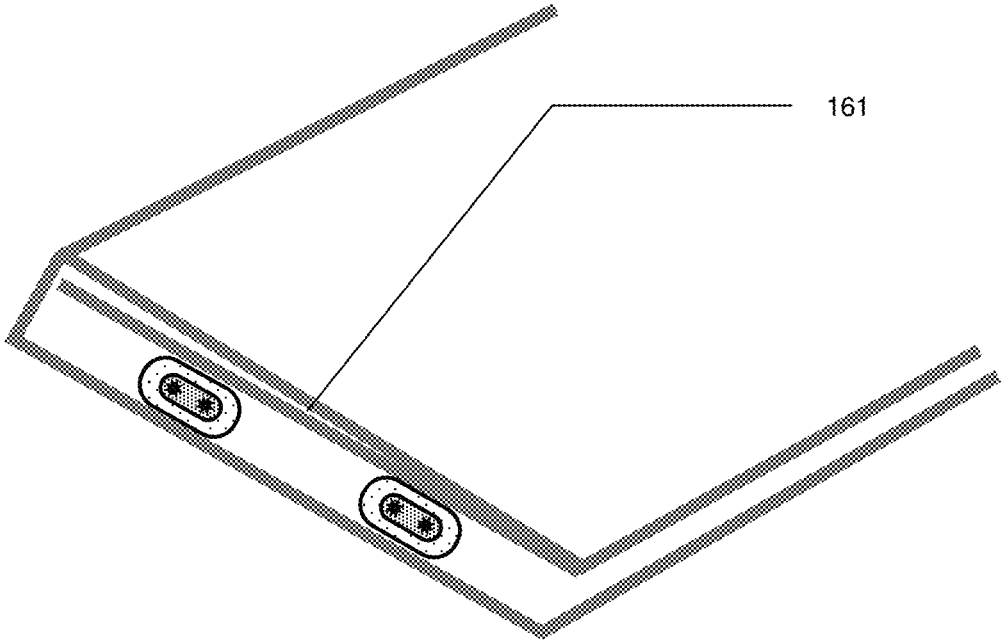
FIG. 16 shows two runs of heating cable installed in the wider panel for applications requiring a wider roof top or valley melt path.

FIGS. 15 and 16 show a wider panel 150 that is typically over eight inches wide for applications that require a larger heated surface area and uses multiple runs of self-regulating heating cable 12. Once again, the same multi-segment heating cable retention cavity ensures a tight thermal contact of the cable to the metal and long term retention not subject to metal fatigue issues. The center bowing effect 161 of the extra segment, like an automotive leaf spring, presents a slightly curved surface that contacts both heating cables 12 for a tight fit.

Figure 17:
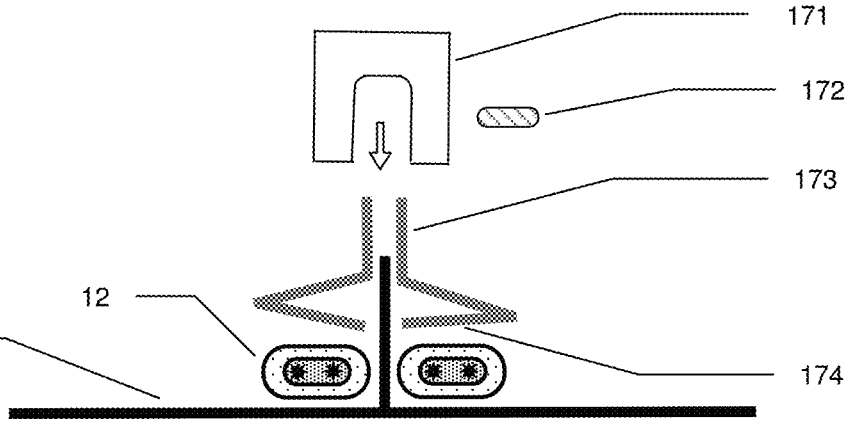
FIG. 17 shows an exploded view of the components used to provide a heated drainage path on either side of the raised seam on a metal roof. The multi-segment retention rail presses the heating cable to the metal roof which in turn acts like a heating panel and provides a heated drainage path for the snow melt water. The seam clamp with rounded inside corners and set screw are used to attach the retention rail to the raised seam.
Figure 18:
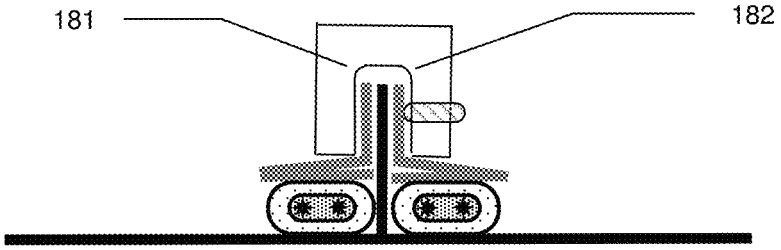
FIG. 18 shows the assembled components.

FIGS. 17 and 18 illustrates a rather complicated system to heat the metal surface of a raised seam roof to provide a heated drain path for snow melt water. A raised seam roof should not be penetrated by screws and the sliding snow can present hundreds of pounds of force to any projections from the roof surface. Some of the current systems use cable retention clips glued the metal surface of the roof. Due to the thermal stress and the UV radiation of the sun, these systems have proven to be unreliable. In this disclosure, raised seam clamps 171 with a side mounted set screw 172 are used in combination with a modified spring loaded retention rail 173, similar to the retention rail 14 in FIG. 1. This upside down version rail 173 is used to create a multi-segment, spring loaded surface 174 that pushes down on the heating cable creating a tight cable cavity for the self-regulating cable 12. The two inside corners 181 and 182 of the extruded metal clamp are rounded to distribute the clamping force across a larger area and provide a larger cavity for the several layers of sheet metal.

Figure 19:
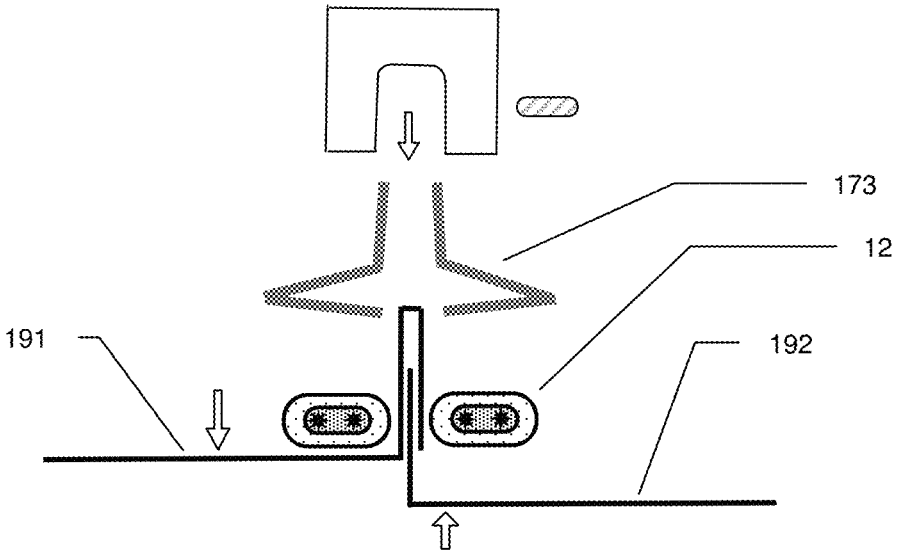
FIG. 19 shows the lower two part flashing components that fit together to form a raised seam flashing assembly that can be place in problem areas of the roof. This raised seam assembly can then be fitted with the components shown in FIG. 17.

FIG. 19 shows an additional invention of a two part raised seam flashing assembly. On the left is the female sheet metal flashing 191 and on the right is the male sheet metal flashing 192. When mated, a raised seam flashing assembly is created that can be combined with the modified spring loaded retention rail 173 system shown in FIGS. 17 and 18 to create a multi-segment, spring loaded heating cable cavity for the self-regulating cable 12. This assembly can be attached to the roof surface with adhesives or screws if the roof structure allows penetration.

Figure 20A:
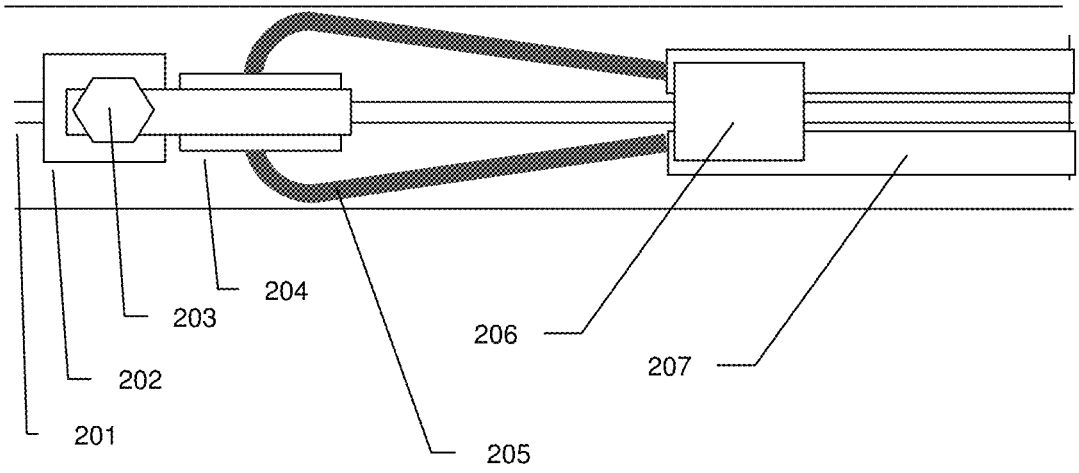
FIG. 20A shows the top view of a heating cable retention system used on a raised seam roof at the top of the cable run and the top view of the cable retention rail as shown in FIG. 17.
Figure 20B:
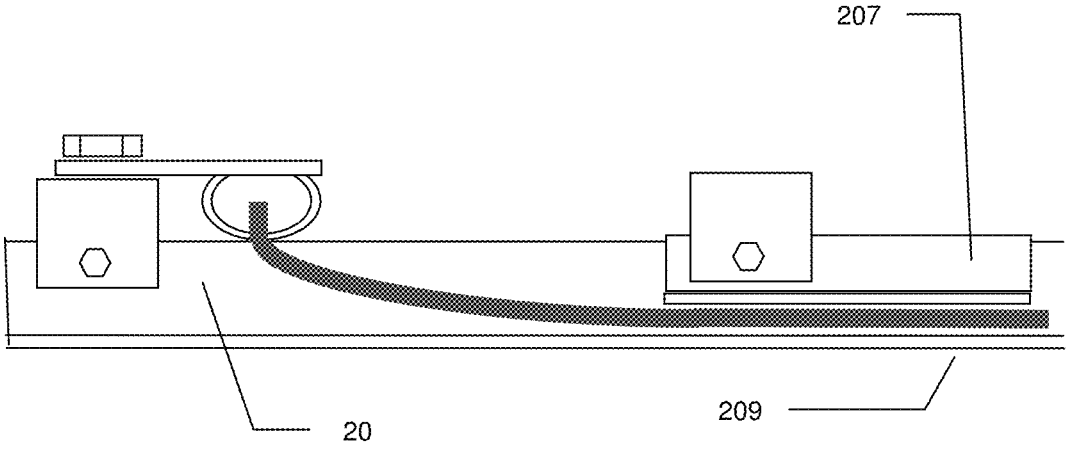
FIG. 20B shows the side view of FIG. 20A with the multi-segment retention rail pressing the heating cable to the metal roof top.

FIG. 20A and FIG. 20B show the top and side views of the heating cable retention system for a raised seam metal roof at the top of the cable run. The left side raised seam 201, seam clamp 202 and top machine threaded bolt 203 hold the padded cable retention loop 204 at the top of the heating cable 205 run. Once the cable is secured at the top of the run, the rounded rectangle shaped heating cable is twisted 90° and lays flat under the modified spring loaded retention rail 207, pressing the heating cable 205 against the top surface of the metal roof 209. This heating effect turns the metal roof surface into a heated raceway to provide the snow melt water a heated drainage path.

Figure 21:
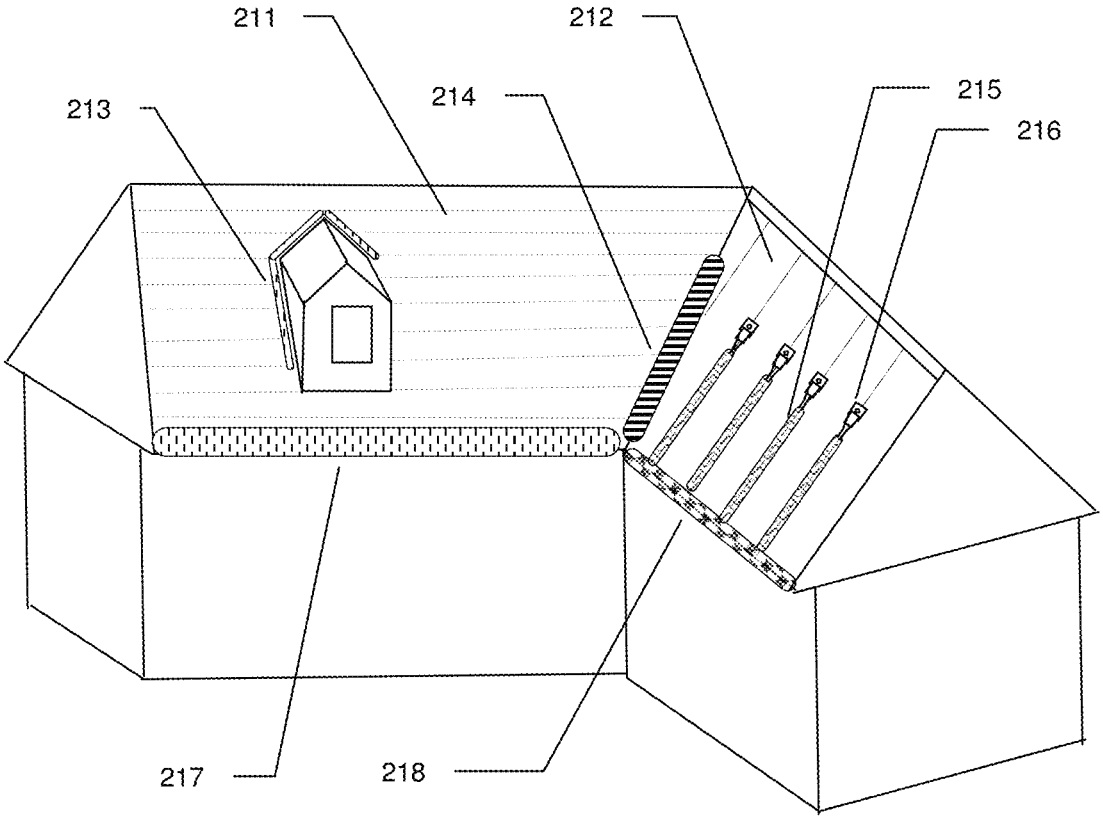
FIG. 21 shows the various roof top panel placement configurations.

FIG. 21 shows the various roof top panel placement configurations. On the left is a conventional shingled roof 211 with a dormer, on the right is a raised seam metal roof 212. The shingled roof is shown with heated panels 213 around the dormer and at the roof drip edge 217. A heated utility panel 214 is used in the valley between the roofs. On the metal roof 212, the multi-segment retention rails 215 hold the heating cable to the top roof surface. The top-of-run heating cable loop retentions 216 are shown. The under the metal roof drip edge retentions 218 are also shown. Not shown are the heated gutters and downspouts, covered by prior art, that are normally required to complete the heated drain path for the snow melt water to drain away from the structure's foundation.

Certain embodiments of the invention have been described; however, they are examples only, and not intended to limit the invention recited in the claims. Variations and safety features which will be obvious to those of ordinary skill in the art, such as the use of any weather tolerant heating cable, and avoiding damage to the cable covering by bending any sharp edges of the spring member away from the cable, fall within the scope of the following claims.

The invention claimed is:

1. A heated continuous roof drainage raceway system with at least one run of self-regulating heating cable for high snow and ice load regions, wherein the raceway is formed by a multi-segment, bellows-like spring member and a thermally conductive base, the spring member, pressing the heating cable against the thermally conductive base, consisting of a strip portion extending along a first side of a substantially rectangular panel, having at least two bends which form at least two overlapping parallel strip segments;

said spring member creating a flexible retention system providing a constant pressure on the heating cable, without damaging the heating cable, thereby minimizing any air gap between the heating cable and the thermally conductive base, and maximizing the heat transfer to the thermally conductive base.

2. The heated continuous roof drainage raceway system of claim 1, wherein an overhanging metal drip edge of a metal roof, with an underside, is the thermally conductive base, and the spring member presses the heating cable against the underside of the overhanging metal drip edge;

along a side of the panel opposite the first side, the spring member has a flange that can be attached with screws to a fascia below the drip edge, creating a two part open sided raceway, open in a direction away from the fascia, exposing the edge of the heating cable;

said spring member forcing the heating cable to follow a waviness or oil canning of the drip edge underside, creating a tight raceway for the cable which maximizes the heat transfer from the heat cable to the underside of the metal roof drip edge;

heat energy generated by the heating cable thereby traveling up the metal roof to keep it free of ice dams and create a continuous heated melt path along the drip edge to drain water under a snow layer.

3. The heated continuous roof drainage raceway system of claim 1, wherein the panel or the thermally conductive base is made from copper, steel or aluminum sheet metal, and the spring member is formed by bending the material on a brake or a roll forming machine, or from a plastic that is extruded.

4. The heated continuous roof drainage raceway system of claim 1, wherein the base comprises a thermally conductive metal slip sheet or snow slide extending up a shingled roof a distance of about one to four rows of shingles and inserted under a shingle row, wrapping around a roof drip edge and extending down along a fascia just below the drip edge, on shingled or composite roofs that are not thermally conductive.

5. The heated continuous roof drainage raceway system of claim 1, wherein the thermally conductive base is a strip of the panel adjacent to the spring member, bent so as to form a front or rear loaded J-hook one piece raceway with the spring member pressing the self-regulating heating cable against the base, which forms an opposite side of the raceway;

the panel being about one to two feet high and held in place under the second, third, or fourth row of shingles, the panel covering respectively the first row of shingles, or the first two, or first three rows of shingles, at the roof edge.

6. The heated continuous roof drainage raceway system of claim 5, wherein the raceway system is secured at locations under the second, third, or fourth row of shingles with attachment screws or nails or glued;

or the raceway system is secured by transition panels extending from a top side of the roof edge, around the roof edge and raceway system, under the roof edge to, and then down along, a fascia under the roof edge, with a drain hole proximate the roof edge, each transition panel placed so as to overlap and secure two adjacent ends of two adjacent front or rear loaded J-hook panels, and fastened at least to the fascia under the roof drip edge;

an inside radius of the transition panel fitting snugly over an outside radius of the J-hook panels and covering a drainage gap between adjacent front or rear loaded J-hook panels.

7. The heated continuous roof drainage raceway system of claim 1, wherein for additional up-roof heating of a shingled or tile roof, the top few inches of additional flat panels can be placed under shingles or tiles higher on the roof, and held in place with screws, nails or glue.

8. The heated continuous roof drainage raceway system of claim 5, wherein the front or rear loaded J-hook one piece raceway is secured to a metal roof by a portion of the panel opposite the spring member, the portion being a few inches to two feet high and, said portion of the panel being slid and secured under an edge of a corrugated, rib panel, or raised seam type metal roof.

9. The heated continuous roof drainage raceway system of claim 8, wherein the raceway system is secured in place with existing roof fasteners near the roof drip edge;

or the raceway system is secured by transition panels extending from a top side of the roof edge, around and under the roof edge and raceway system to, and then down along, a fascia under the roof edge, with a drain hole proximate the roof edge, each transition panel placed so as to overlap and secure two adjacent ends of a two adjacent front or rear loaded J-hook panels, and fastened at least to the fascia under the roof drip edge;

an inside radius of the transition panel fitting snugly over an outside radius of the J-hook panels and covering a drainage gap between adjacent front or rear loaded J-hook panels.

10. The heated continuous roof drainage raceway system of claim 5, wherein the front loaded J-hook raceway forms a one piece, open-sided raceway, open in a direction away from the fascia, exposing the edge of the heating cable, and the rear loaded J-hook raceway forms a one piece, open-sided raceway, open in a direction toward the fascia.

11. The heated continuous roof drainage raceway system of claim 3, wherein for thick dimensioned shingles or tile roofs the slip sheet can be sized to cover only the first row of shingles.

12. The heated continuous roof drainage raceway system of claim 1, wherein a one piece raceway is formed wide enough to hold at least one self-regulating heating cable run, allowing use on roof valleys, and as flashing at vertical protrusions from the roof.

13. The panel recited in claim 12, wherein the panel is formed with a right angle vertical member designed to be used as a flashing sealed to chimneys, dormers or second stories.

14. The heated continuous roof drainage raceway system of claim 1, comprising a multi-component system that provides a heated snow melt water drainage raceway on a top surface of a raised seam metal roof wherein, a combination of a threaded bolt holding a padded cable loop to a seam clamp which is attached to a raised seam on an exterior metal roof surface, securely holding a top loop of the self-regulating heating cable and preventing sliding snow and ice from dislodging the heating cable from the exterior surface of the roof;

a rounded rectangle shaped heating cable lying flat against the top surface of the metal roof which constitutes the thermally conductive metal base;

the cable thus seated in a three sided raceway formed by the metal roof surface, the raised seam and a modified inverted spring member;

the parts of this raceway system being held in place by a seam clamp that may have rounded inside corners to provide additional clamping strength while minimizing material usage, and a set screw;

the clamp's set screw securing the spring member or members to an exterior raised seam of the roof, with the heating cable in firm, thermally conductive contact with an exterior flat metal surface of the roof adjacent the seam, providing a heated drainage path for snow melt water.

15. The heated continuous roof drainage raceway system of claim 14, wherein the raceway is installed on only one side of the raised seam, crossing over to a next seam at the top and bottom of a self-regulating heating cable run.

16. The heated continuous roof drainage raceway system of claim 14, further comprising a two part sheet metal panel, each panel with a vertical member, forming a raised seam wherein, along a seam length, one part presents a folded over cavity which the other part slides into, creating a raised seam flashing that can be placed at various exterior locations on a roof and heated to provide a heated drain path for snow melt water.

17. The heated continuous roof drainage raceway system of claim 16, wherein outer edges of the two part sheet metal panel can be mounted under shingles and held in place with fasteners or adhesive.

18. The heated continuous roof drainage raceway system of claim 16, wherein outer edges of the two part sheet metal panel can be bent vertical upward allowing the raceway to be sealed against vertical protrusions from a roof associated with a chimney, dormer or second story.

* * * * *